US009239045B2

(12) United States Patent
Ribeiro et al.

(10) Patent No.: US 9,239,045 B2
(45) Date of Patent: Jan. 19, 2016

(54) OFF-AXIS VARIABLE DISPLACEMENT OIL PUMP

(75) Inventors: Eduardo Gubbiotti Ribeiro, Sao Paulo (BR); Ayres Pinto de Andrade Filho, Sao Paulo (BR); Joao Luiz de Carvalho Meira, Sao Paulo (BR)

(73) Assignee: Melling do Brasil Componentes Automotivos Ltds. (BR)

( * ) Notice: Subject to any disclaimer, the term of this patent is extended or adjusted under 35 U.S.C. 154(b) by 226 days.

(21) Appl. No.: 13/704,292

(22) PCT Filed: Jun. 16, 2010

(86) PCT No.: PCT/IB2010/001462

§ 371 (c)(1),
(2), (4) Date: Dec. 14, 2012

(87) PCT Pub. No.: WO2011/158055

PCT Pub. Date: Dec. 22, 2011

(65) Prior Publication Data

US 2013/0089441 A1 Apr. 11, 2013

(51) Int. Cl.

| | |
|---|---|
| ***F01M 1/02*** | (2006.01) |
| ***F04B 17/05*** | (2006.01) |
| ***F01M 1/16*** | (2006.01) |
| ***F01M 11/03*** | (2006.01) |
| ***F02B 67/04*** | (2006.01) |

(52) U.S. Cl.

CPC ..... *F04B 17/05* (2013.01); *F01M 1/02* (2013.01); *F01M 1/16* (2013.01); *F01M 11/03* (2013.01); *F02B 67/04* (2013.01); *F01M 2001/0238* (2013.01); *F01M 2001/0246* (2013.01); *F01M 2001/0269* (2013.01)

(58) Field of Classification Search

CPC ..... F01M 2001/0238; F01M 2001/0079; F01M 2001/0284; F01M 2001/035; F01M 1/02; F01M 1/16; F01M 11/03; F02B 67/04; F04C 15/0061; F04B 17/05

USPC ..... 417/220, 364; 123/196 R, 195 A, 198 C

See application file for complete search history.

(56) References Cited

U.S. PATENT DOCUMENTS 2,572,250 A * 10/1951 Davis ..... 184/6.28
3,728,995 A * 4/1973 Schramm ..... 123/195 A (Continued)

FOREIGN PATENT DOCUMENTS

DE 197 37 491 A2 3/1999
EP 0 807 748 Al 11/1997

(Continued)

*Primary Examiner* — Devon Kramer
*Assistant Examiner* — Nathan Zollinger
(74) *Attorney, Agent, or Firm* — Young Basile Hanlon & MacFarlane P.C.

(57) ABSTRACT

An oil pump assembly for use with an internal combustion engine having an engine block, a crankshaft that is rotatable with respect to the engine block on a crankshaft axis, and a sump that is connected to the engine block for receiving and storing oil therein. The oil pump assembly includes a housing and a drive assembly that is arranged on the housing. The drive assembly is connected to the crankshaft for rotation in unison therewith. An oil pump is connected to the housing for pumping oil between an inlet and an outlet of the oil pump in response to rotation of a drive shaft. The drive shaft is connected to the drive assembly for rotation in unison therewith.

14 Claims, 5 Drawing Sheets

(56) References Cited

U.S. PATENT DOCUMENTS

| | | | | | |
|---|---|---|---|---|---|
| 4,423,707 | A * | 1/1984 | Sihon | F01M 1/02 | 123/195 A |
| 4,462,350 | A * | 7/1984 | Kurata | 123/196 CP | |
| 5,078,106 | A * | 1/1992 | Matsuo et al. | 123/196 R | |
| 6,722,860 | B2 * | 4/2004 | Asano | F01M 1/02 | 123/196 R |
| 2010/0014991 | A1 * | 1/2010 | Pryor et al. | 417/220 | |

FOREIGN PATENT DOCUMENTS

| | | | | |
|---|---|---|---|---|
| EP | 1 164 262 | A2 | | 12/2001 |
| EP | 1 316 711 | A2 | | 6/2003 |
| GB | 397225 | | * | 8/1933 |
| GB | 1065679 | A | * | 4/1967 |
| WO | 2011158055 | | | 12/2011 |

* cited by examiner

OFF-AXIS VARIABLE DISPLACEMENT OIL PUMP

FIELD OF THE INVENTION

The present invention relates to the field of oil pumps for internal combustion engines.

BACKGROUND OF THE INVENTION

In internal combustion engines, an oil pump is provided to circulate oil and maintain an acceptable level of oil pressure within the engine. It is well known to drive oil pumps using the rotational force generated by the crankshaft of the engine.

Most oil pumps that are driven by the crankshaft follow one of two well-known designs. The first places the pump directly on the crankshaft, such that the crankshaft passes through the rotor of the pump. Thus, the pump is arranged around the crankshaft itself. For example, in a pump that uses rotating vanes that move fluid between an inlet and an outlet, the crankshaft itself is the axis around which the vanes rotate.

The second well known arrangement is to locate the pump external to the internal combustion engine, such as by bolting the pump to an external portion of the internal combustion engine, or by otherwise supporting the oil pump with respect to the internal combustion engine. In such systems, the oil pump includes a pulley that is driven by a belt or a chain that is connected to a crankshaft pulley on the exterior of the internal combustion engine.

Both designs have their advantages and disadvantages. For example, locating the pump on the crankshaft simplifies assembly, but at the same time requires that the dimensions of the pump be increased, such that the crankshaft may pass through the pump. This results in an unnecessarily large size for the oil pump and places constraints on the design of the pump that tend to reduce its efficiency. Belt or chain driven oil pumps may be produced compactly, but require additional assembly steps in mounting the pump to the internal combustion engine.

It would be desirable to have an oil pump that simplifies assembly, operates efficiently, and is of relatively small size.

SUMMARY OF THE INVENTION

The invention provides an oil pump assembly for use with an internal combustion engine having an engine block, a crankshaft that is rotatable with respect to the engine block on a crankshaft axis, and a sump that is connected to the engine block for receiving and storing oil therein. The oil pump assembly includes a housing and a drive assembly that is arranged on the housing. The drive assembly is connected to the crankshaft for rotation in unison therewith. An oil pump is connected to the housing for pumping oil between an inlet and an outlet of the oil pump in response to rotation of a drive shaft. The drive shaft is connected to the drive assembly for rotation in unison therewith.

The housing may be connected to the engine block. Furthermore, the oil pump may be disposed within the sump. In addition, the housing may be connected to the sump.

The drive assembly may have an input member that rotates in unison with the crankshaft. Furthermore, the input member may be receivable upon the crankshaft, such that the crankshaft extends through the input member. The drive assembly may also include an output member that rotates in response to rotation of the input member of the drive assembly. The drive shaft may be connected to the output member of the drive assembly for rotation in unison therewith.

The drive assembly may be a gear train, wherein the input member is an input gear and the output member is an output gear. As an alternative, the drive assembly may include a chain for transmitting a rotational force from the input member to the output member. As another alternative, the drive assembly may include a belt for transmitting a rotational force from the input member to the output member.

The oil pump assembly may include an intake tube that is connected to the inlet of the pump and is disposed within the sump of the internal combustion engine.

A filter mount may be provided on the housing in communication with the pump for filtering the oil that is pumped by the oil pump.

The oil pump may be a variable displacement oil pump. Furthermore, the oil pump may include a plurality of vanes and a cam ring, wherein pivotal motion of the cam ring is operable to change the position of the vanes and the cam ring with respect to the inlet and the outlet to change the flow rate of the pump. Pivotal motion of the cam ring may be regulated by oil pressure acting on the cam ring.

BRIEF DESCRIPTION OF THE DRAWINGS

The description herein makes reference to the accompanying drawings, wherein like-referenced numerals refer to like parts throughout several views and wherein.

DESCRIPTION OF THE PREFERRED EMBODIMENT

Figure 1:
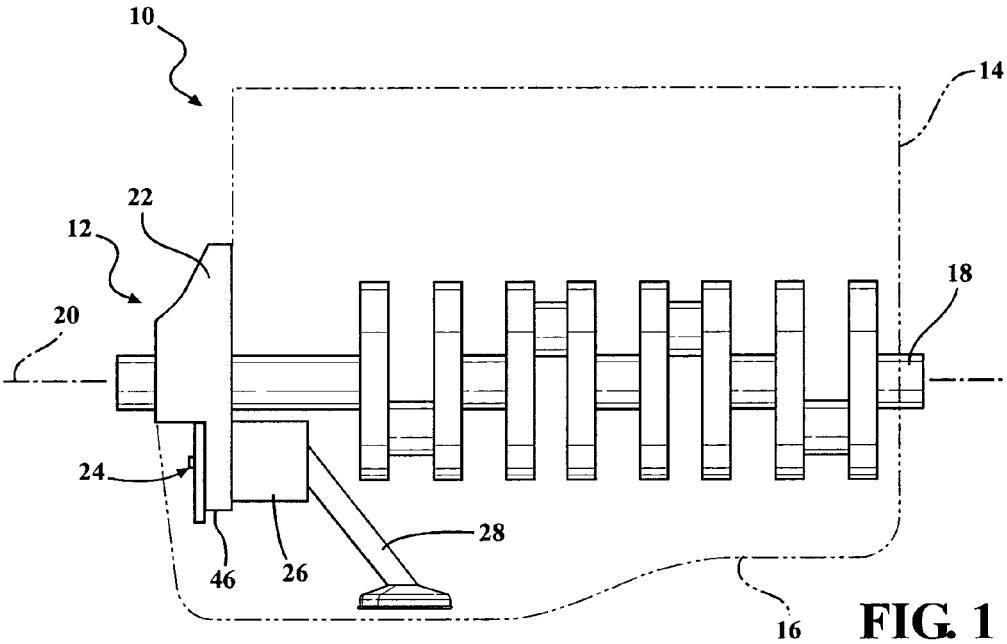
FIG. 1 is an illustration showing an internal combustion engine having an oil pump assembly according to the present invention.

FIG. 1 shows an internal combustion engine 10 having an oil pump assembly 12 according to the present invention. The internal combustion engine 10 is conventional in nature, and thus may be any internal combustion engine now known or later developed. The internal combustion engine includes an engine block 14, an oil pan or sump 16, and a crankshaft 18 that is disposed between the engine block 14 and the sump 16 for rotation along a crankshaft axis 20. Of course, the internal combustion engine 10 includes a vast number of additional components, but these components are omitted for purposes of clarity.

The oil pump assembly 12 is connected directly to the engine block 14 of the internal combustion engine. In addition, at least a portion of the oil pump assembly 12 is disposed within the sump 16 of the internal combustion engine, and the oil pump assembly 12 may thus also be directly connected to the sump 16. The connections between the oil pump assembly 12, the engine block 14, and the sump 16 are fixed in nature, such that the oil pump assembly 12, as a whole, is not movable with respect to the engine block 14 or the sump 16. However, the oil pump assembly 12 is connected to the crankshaft 18 for receiving a rotational input force, as will be explained in detail herein.

Figure 2:
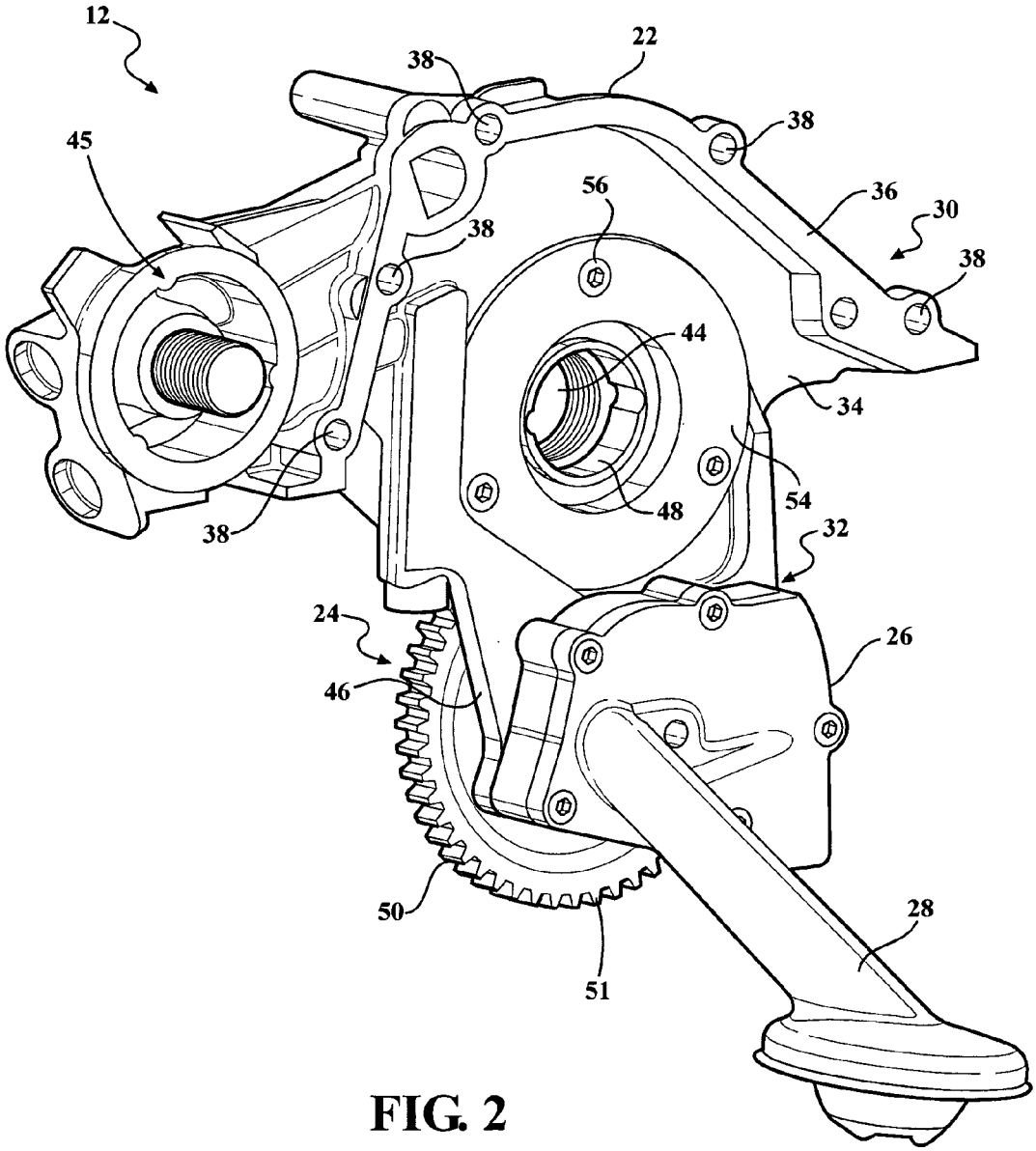
FIG. 2 is a perspective view showing the oil pump assembly.
Figure 3:
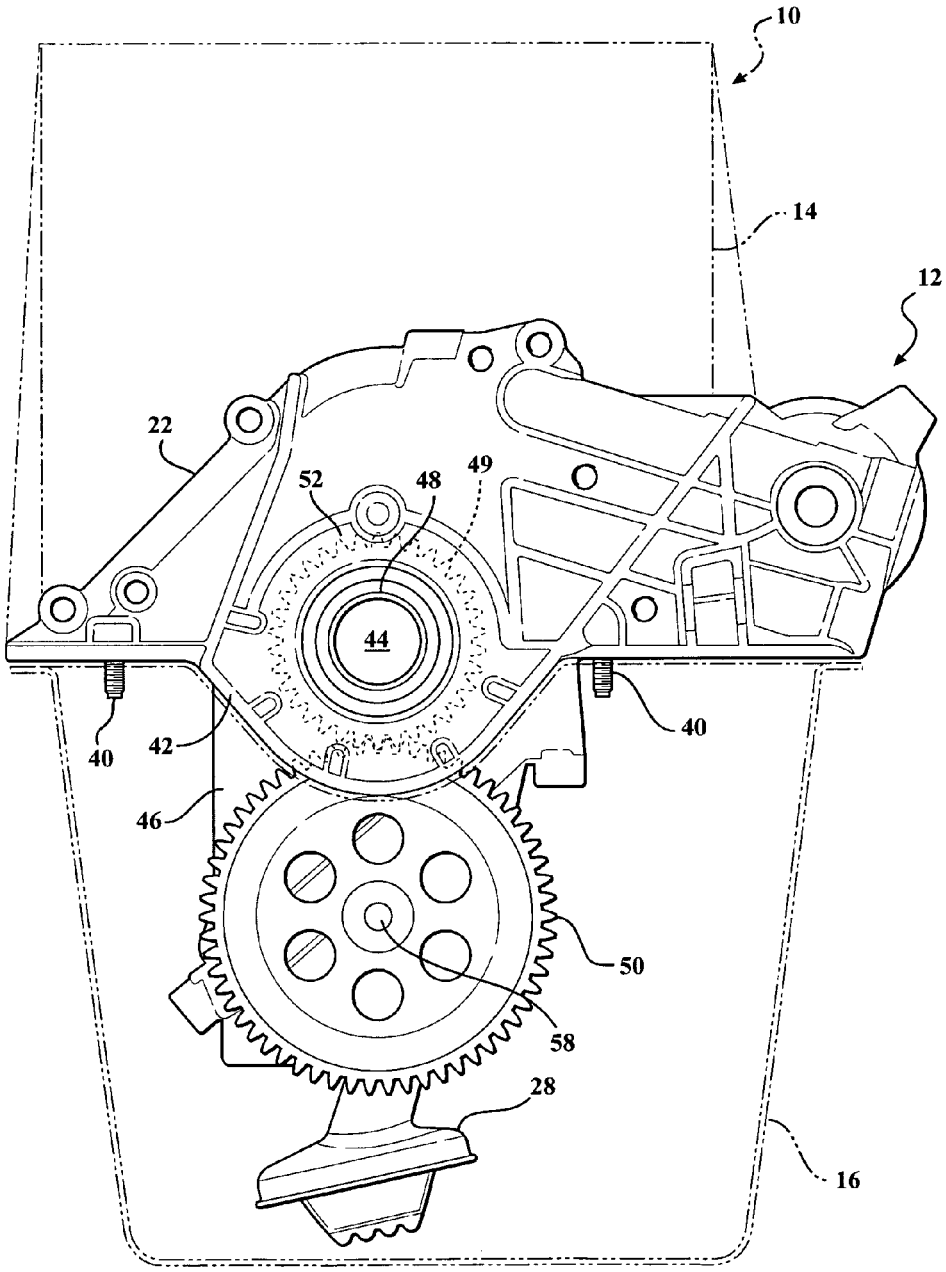
FIG. 3 is a side view showing the oil pump assembly.

As shown in FIGS. 2 and 3, the main components of the oil pump assembly 12 are a housing 22, a drive assembly such as a gear train 24, an oil pump 26, and an intake tube 28. As will be explained further herein, the gear train 24, the oil pump 26, and the intake tube 28 are all supported by the housing 22, such that the oil pump assembly 12 is modular in nature. This allows the oil pump assembly 12 to be assembled completely in advance of its attachment to the engine block 14 and the sump 16 of the internal combustion engine 10. Furthermore, the gear train 24 allows the oil pump 26 to be located off of the crankshaft axis 20, while remaining on the housing 22 as a part of a modular unit.

The housing 22 includes an upper portion 30 and a lower portion 32. The upper portion 30 of the housing 22 is at least partially exposed to the exterior of the internal combustion engine 10 when it is assembled with respect to the engine block 14 and the sump 16. An aperture 44 is formed through the upper portion 30 of the housing 22 for receiving a portion of the crankshaft 18 there through, to allow connection of the crankshaft 18 to the gear train 24.

In order to connect the housing 22 to the engine block 14, an interior surface 34 of the upper portion 30 is disposed in a direct facing relationship with the engine block 14 when assembled, and a first mounting flange 36 is adapted to engage the engine block 14 itself. A first plurality of mounting holes 38 are provided on the mounting flange 36 for connecting the housing 22 to the engine block 14 using conventional fasteners (not shown), such as bolts. A second plurality of mounting holes 40 is provided on a second mounting flange 42. The mounting holes 40 are oriented downwardly for connecting the housing 22 to the sump 16 in a similar manner.

In order to allow connection of an oil filter (not shown) to the oil pump assembly 12, a filter mount 45 is provided on the upper portion 30 of the housing 22 in communication with the pump 26 for filtering the oil that is pumped by the oil pump 26. The filter mount 45 includes a connecting means for attaching the oil filter thereto, as well as necessary in-flow and out-flow paths for the oil with respect to the filter. Of course, the filter mount 45 is positioned such that the filter is positioned external to the internal combustion engine 10 when the oil pump assembly 12 is assembled with respect to the internal combustion engine 10.

In contrast to the upper portion 30 of the housing 22, the lower portion 32 of the housing 22 is disposed entirely within the sump 16 of the internal combustion engine 10. The lower portion 32 of the housing 22 includes a support flange 46. The support flange 46 extends downwardly from the second mounting flange 42 and is configured to support at least a portion of the gear train 24 as well as the oil pump 26 and the intake tube 28.

The drive assembly such as the gear train 24 is arranged on the housing 22, and is connected to the crankshaft 18 for rotation in unison therewith. The gear train 24 includes an input member, such as an input gear 48 that rotates in unison with the crankshaft 18, and an output member, such as an output gear 50 that rotates in response to rotation of the input gear 48. However, it should be understood that one or more idler gears (not shown) could be provided as a part of the gear train 24 and supported upon the housing 22 within the scope of the invention.

The input gear 48 is receivable upon the crankshaft 18, such that the crankshaft 18 extends through the input gear 48 aperture 44 that is defined through the housing 22. The input gear 48 is supported with respect to the housing 22, such as by disposition of the input gear 48 within an open-sided cavity 52 that is formed on the upper portion 30 of the housing 22 around and adjacent to the aperture 44. To retain the input gear 48 within the cavity 52, the input gear 48 may be captured between the housing 22 and a retainer ring 54 that is secured to the housing 22 in a rigid and fixed manner, such as by fasteners 56. The input gear 48 includes a plurality of teeth 49 that are engageable with a plurality of teeth 51 of the output gear 50 or with the teeth of an idler gear, if one is provided as a part of the gear train 24.

The output gear 50 is supported for rotation with respect to the housing 22 on a drive shaft 58 that extends through the support flange 46 of the lower portion 32 of the housing 22 along a drive shaft axis 59 that is parallel to and offset from the crankshaft axis 20. The drive shaft 58 is connected to the gear train 24 for rotation in unison therewith, and more particularly, the drive shaft 58 is connected to the output gear 50 for rotation in unison therewith. The drive shaft 58 may be a portion of the oil pump 26 or may be separate from the oil pump 26. The input gear 48 and the output gear 50 are gearingly connected to one another, by direct engagement of the teeth 49 of the input gear 48 with the teeth 51 of the output gear 50 or by engagement of the input gear 48 and the output gear 50 with one or more idler gears, as explained previously, such that the output gear 50 rotates in response to and in unison with rotation of the input gear 48. In order to allow engagement of the input gear 48 and the output gear 50, the output gear 50 may extend partially into the cavity 52 that is formed on the upper portion 30 of the housing 22.

The oil pump 26 is connected to the housing 22 for pumping oil between an inlet 80 and an outlet 82 of the oil pump 26 in response to rotation of the drive shaft 58. The oil pump 26 is connected to and supported by the support flange 46 of the lower portion 32 of the housing 22. The oil pump 26 is located entirely within the sump 16 of the internal combustion engine 10, and is connected to the intake tube 28, which is connected to the inlet 80 of the oil pump 26 and is disposed within the sump 16 of the internal combustion engine 10 such that it is in communication with the oil that is located within the sump 16 to transport oil from the sump 16 to the oil pump 26.

While the invention is not limited by the type of oil pump utilized, it is expressly contemplated that the oil pump 26 may be a variable flow oil pump that is provided as a portion of the oil pump assembly 12 and is assembled therewith as a modular unit that may be assembled directly to the engine block 14 of the internal combustion engine 10.

Figure 4:
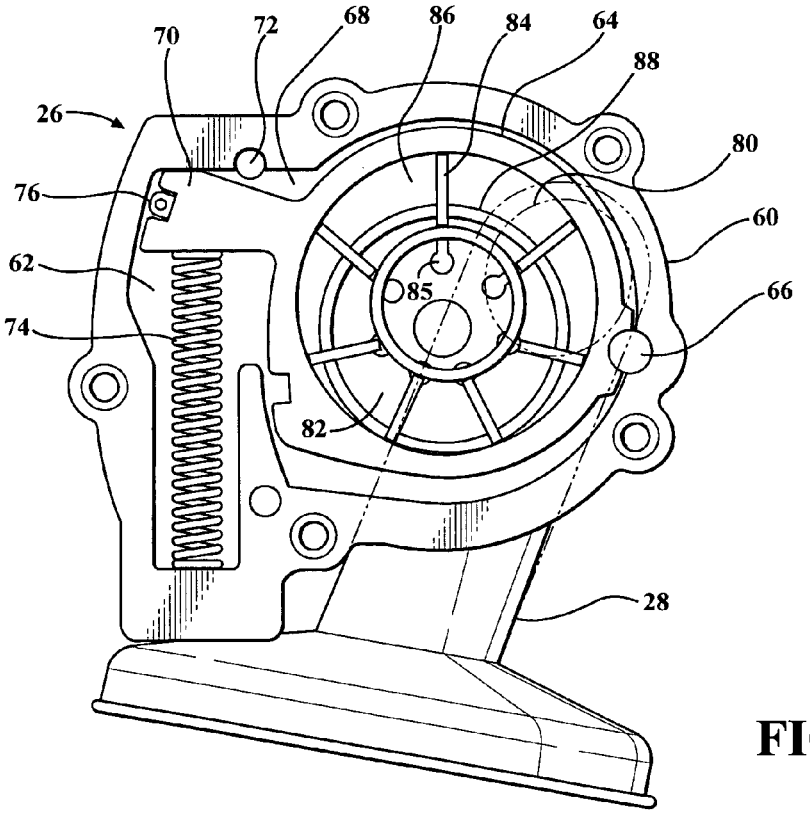
FIG. 4 is a side view showing a variable displacement pump of the oil pump assembly.

As shown in FIG. 4, the oil pump 26 includes a housing 60 having a cavity 62 defined therein. A cam ring 64 is disposed within the cavity 62 and is mounted such that it may pivot slightly within the cavity 62, on an axis that is defined by a pivot pin 66 that is located along an outer periphery of the cavity 62. The cam ring 64 is moveable about the pivot pin 66 between a first position, wherein a maximum flow rate for the oil pump 26 is defined, and a second position, wherein a minimum flow rate for the oil pump 26 is defined.

Movement of the cam ring 64 between the first position and the second position is regulated by oil pressure in an area 68 that is disposed adjacent to an arm 70 that is connected to and extends outward from the cam ring 64. Oil is introduced into the area 68 by a port 72, and the oil pressure within the area 68 acts upon the arm 70 to pivot the cam ring 64 about the pivot pin 66. On the side of the arm 70 opposite the area 68, a compression spring 74 is in engagement with the arm 70 to bias the arm 70 toward the port 72 against the pressure of the oil in the area 68. A seal 76 between the arm 70 and the housing 60 prevents oil within the area 68 from entering the area in which the compression spring 74 is located. Thus, the oil pressure within the area 68 is operable to pivotally move the cam ring 64 between the first position and the second position, thereby changing the rate at which oil is pumped by the oil pump 26.

A pumping chamber 78 is defined within the interior of the cam ring 64. Within the pumping chamber 78, the inlet 80 and the outlet 82 are defined by the housing 60 of the oil pump 26. A plurality of flat vanes 84 are provided in the pumping chamber 78 and are disposed in slots 85 that are formed through a base plate 86 that rotates with respect to the housing 60 in response to rotation of the drive shaft 58. Thus, the flat vanes 84 also rotate in response to rotation of the drive shaft 58.

A regulating ring 88 is provided within the pumping chamber 78 and is located centrally with respect to the flat vanes 84. The regulating ring 88 is in engagement with all of the flat vanes 84, and thus, when the cam ring 64 moves about the pivot pin 66 within the cavity 62 defined by the housing 60, it engages at least some of the flat vanes 84, and it drives them along their respective slots 85. At the same time, impingement of these flat vanes 84 upon the regulating ring 88 causes the regulating ring 88 to engage the remainder of the flat vanes 84 and drive them along their respective slots 85. Then, as the base plate 86 of the oil pump 26 rotates within the pumping chamber 78, each of the flat vanes 84 travels along its respective slot 85 in response to the position of the cam ring 64 and the regulating ring 88. Thus, pivotal motion of the cam ring 64 is operable to change the position of the flat vanes 84 and the position of the cam ring 64 with respect to the inlet 80 and the outlet 82, thereby changing the flow rate of the oil pump 26 as the cam ring 64 moves between the first position and the second position.

It should be understood that the invention is not limited to a drive assembly in the form of the gear train, but rather, any drive assembly having an input member that is receivable on the crankshaft for rotation therewith and an output member that rotates in response to rotation of the input member may be utilized.

Figure 5:
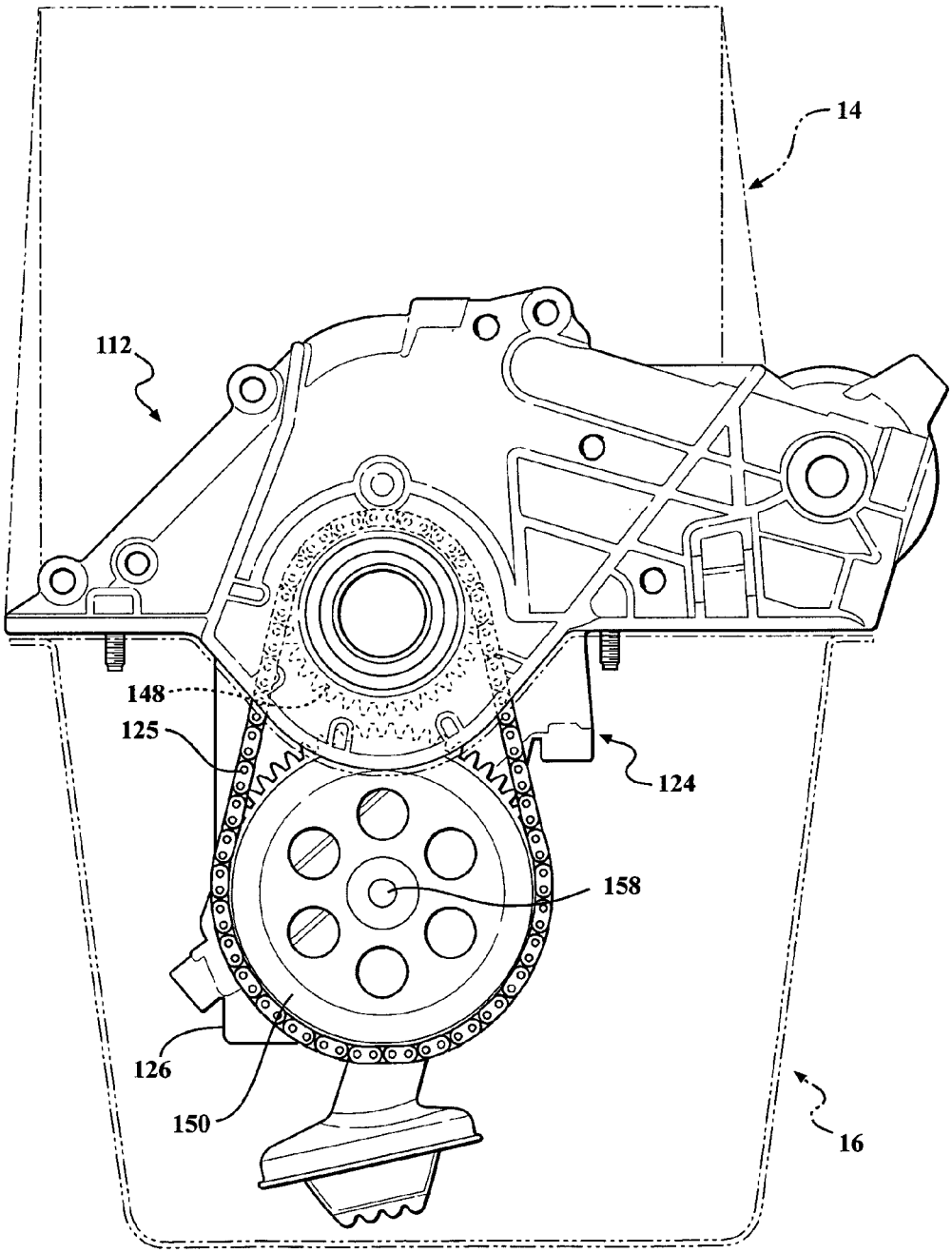
FIG. 5 is a side view showing a first alternative embodiment of the oil pump assembly.

As one example of an alternative drive assembly, FIG. 5 shows an oil pump assembly 112 according to a first alternative embodiment, wherein the drive assembly is the form of a chain drive assembly 124 that is arranged on a housing 122 of the oil pump assembly 112. The drive assembly 124 includes an input sprocket 148 that is disposed on the crankshaft 18 of the internal combustion engine 10 for rotation in unison therewith and an output sprocket 150 that is connected to a drive shaft 158 of an oil pump 126. A chain 125 is in engagement with both the input sprocket 148 and the output sprocket 150 to transmit a rotational force from the input sprocket 148 to the output sprocket 150 such that the output sprocket 150 rotates in response to rotation of the input sprocket 148.

Figure 6:
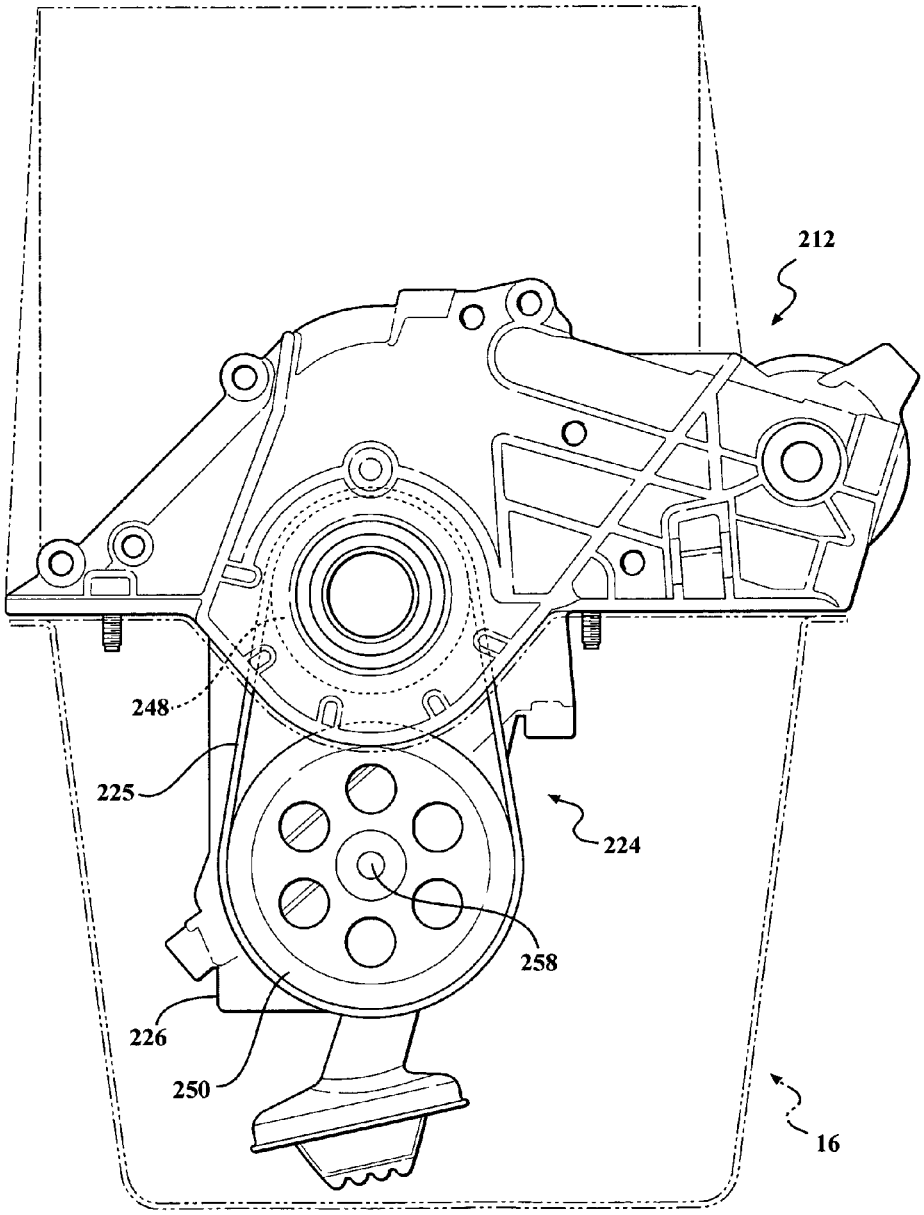
FIG. 6 is a side view showing a second alternative embodiment of the oil pump assembly.

As another example of an alternative drive assembly, FIG. 6 shows an oil pump assembly 212 according to a second alternative embodiment, wherein the drive assembly is the form of a belt drive assembly 224 that is arranged on a housing 222 of the oil pump assembly 212. The drive assembly 224 includes an input pulley 248 that is disposed on the crankshaft 18 of the internal combustion engine 10 for rotation in unison therewith and an output pulley 250 that is connected to a drive shaft 258 of an oil pump 226. A belt 225, such as a ribbed belt, a multi-groove belt, a v-belt, a flat belt or other suitable type of belt is in engagement with both the input pulley 248 and the output pulley 250 to transmit a rotational force from the input pulley 248 to the output pulley 250 such that the output pulley 250 rotates in response to rotation of the input pulley 248.

While the invention has been described in connection with what is presently considered to be the most practical and preferred embodiment, it is to be understood that the invention is not to be limited to the disclosed embodiments, but to the contrary, it is intended to cover various modifications and equivalent arrangements included within the spirit and scope of the appended claims. The scope is to be accorded the broadest interpretation so as to encompass all such modifications and equivalent structures as is performed under the law.

What is claimed is:

1. A modular oil pump assembly for use with an internal combustion engine having an engine block, a crankshaft that is rotatable with respect to the engine block on a crankshaft axis, and a sump that is connected to the engine block for receiving and storing oil therein, the modular oil pump assembly comprising:

a housing having an aperture formed therethrough along an aperture axis for receiving the crankshaft, a first mounting flange for connecting the housing to the engine block, and a second mounting flange for connecting the housing to the sump, wherein the first mounting flange is oriented such that it faces in a direction that is parallel to the aperture axis and the second mounting flange is oriented such that it faces in a direction that is perpendicular to the aperture axis;

a drive assembly that is arranged on and supported by the housing, the drive assembly having an input member that is supported by the housing adjacent to the aperture and is receivable upon the crankshaft, such that the crankshaft extends through the aperture of the housing and the input member to cause rotation of the input member in unison with the crankshaft; and an oil pump that is connected to and supported by the housing for pumping oil between an inlet and an outlet of the oil pump in response to rotation of a drive shaft that is connected to the drive assembly for rotation in unison therewith, wherein the oil pump is configured to be disposed within the sump.

2. The modular oil pump assembly of claim 1, wherein the input member is receivable upon the crankshaft such that the crankshaft extends through the input member.

3. The modular oil pump assembly of claim 1, further comprising:

the drive assembly having an output member that is supported by the housing and rotates in response to rotation of the input member of the drive assembly.

4. The modular oil pump assembly of claim 3, wherein the drive shaft is connected to the output member of the drive assembly for rotation in unison therewith.

5. The oil modular pump assembly of claim 4, wherein the drive assembly is a gear train, the input member is an input gear, and the output member is an output gear.

6. The modular oil pump assembly of claim 4, further comprising:

the drive assembly including a chain for transmitting a rotational force from the input member to the output member.

7. The modular oil pump assembly of claim 4, further comprising:

the drive assembly including a belt for transmitting a rotational force from the input member to the output member.

8. The modular oil pump assembly of claim 1, further comprising:

an intake tube that is connected to the inlet of the pump and is disposed within the sump of the internal combustion engine.

9. The modular oil pump assembly of claim 1, further comprising:

a filter mount that is provided on the housing in communication with the pump for filtering the oil that is pumped by the oil pump.

10. The modular oil pump assembly of claim 1, wherein the oil pump is a variable displacement oil pump.

11. The modular oil pump assembly of claim 10, further comprising:

the oil pump including a plurality of vanes and a cam ring, wherein pivotal motion of the cam ring is operable to change the position of the vanes and the cam ring with respect to the inlet and the outlet to change the flow rate of the pump.

12. The modular oil pump assembly of claim 11, wherein pivotal motion of the cam ring is regulated by oil pressure acting on the cam ring.

13. An internal combustion engine, comprising:

an engine block;

a crankshaft that is rotatable with respect to the engine block on a crankshaft axis;

a sump that is connected to the engine block for receiving and storing oil therein; and a modular oil pump assembly comprising:

a housing having an aperture formed along the crankshaft axis, a first mounting flange that is connected to the engine block, a second mounting flange that is connected to the sump, an upper portion that is at least partially exposed to an exterior of the sump and engine block, and a lower portion that extends downward from the upper portion adjacent to the second mounting flange and is disposed entirely within the sump, a drive assembly that is arranged on and supported by the housing, the drive assembly having an input member that is supported by the upper portion of the housing adjacent to the aperture and is disposed on the crankshaft such that the crankshaft extends through the aperture of the housing and the input member to cause rotation of the input member in unison with the crankshaft, and an output member that is supported by the lower portion of the housing and rotates in response to rotation of the input member, and an oil pump that is connected to and supported by the lower portion of the housing such that it is disposed with the sump for pumping oil between an inlet and an outlet of the oil pump in response to rotation of a drive shaft that is connected to the output member of the drive assembly for rotation in unison therewith.

14. The internal combustion engine of claim 13, wherein the first mounting flange is oriented such that it faces in a direction that is parallel to the crankshaft axis and the second mounting flange is oriented such that it faces in a direction that is perpendicular to the crankshaft axis.

* * * * *